United States Patent [19]

Engelmayer

[11] Patent Number: 4,785,970

[45] Date of Patent: Nov. 22, 1988

[54] TISSUE PACK

[75] Inventor: Gerhard Engelmayer, Baden, Austria

[73] Assignee: Pakotex Hygiene-Papier Vertriebsgesellschaft m.b.H., Vienna, Austria

[21] Appl. No.: 936,414

[22] Filed: Dec. 1, 1986

[30] Foreign Application Priority Data

Dec. 4, 1985 [AT] Austria ..... A3521/85

[51] Int. Cl.[4] ..... A47K 10/42; B65H 1/04

[52] U.S. Cl. ..... 221/47; 221/63

[58] Field of Search ..... 221/34, 35, 44–54, 221/56, 58, 61, 63, 102; 229/175

[56] References Cited

U.S. PATENT DOCUMENTS

| | | | |
|---|---|---|---|
| 1,773,652 | 8/1930 | Traver | 221/302 X |
| 1,819,753 | 8/1931 | Morris | 221/58 |
| 1,980,059 | 11/1934 | Housen | 221/63 X |
| 2,621,788 | 12/1952 | Hitchcock | 221/63 |
| 3,265,242 | 8/1966 | Davis | 221/63 |
| 3,490,645 | 1/1970 | Glass et al. | 221/48 |
| 4,478,354 | 10/1984 | Nothesis | 221/34 |
| 4,570,820 | 2/1986 | Murphy | 221/34 |
| 4,651,895 | 3/1987 | Niske et al. | 221/63 |

*Primary Examiner*—F. J. Bartuska

*Attorney, Agent, or Firm*—Ralph H. Dougherty

[57] ABSTRACT

Paper handkerchiefs pack having a stack of folded handkerchiefs 3 enclosed on all sides by a foil envelope 2. The handkerchiefs 3 have a fold which has an edge 6 at the outside of the folded handkerchief that lies free with the two edges 7, 8 extending from it, one of these edges 7 running in the middle of the longitudinal extent of the surface of the handkerchief from one longitudinal edge thereof to the other longitudinal edge thereof and the other of these edges running along a longitudinal edge of the folded handkerchief. To form a dispenser opening, a line of weakness 4 is provided which extends over the middle of the broad upper surface 5 of the foil envelope.

17 Claims, 3 Drawing Sheets

TISSUE PACK

BACKGROUND OF THE INVENTION

The present invention relates to a paper handkerchiefs pack with a stack of folded paper handkerchiefs enclosed on all sides by a foil envelope, this foil envelope having a line of weakness running only over the broadside surface of the foil envelope following the extent of the surface of the folded paper handkerchiefs.

The envelope of paper handkerchiefs packs is to provide good protection not only in the closed condition of the packs, but also over a long period of time after the foil envelope has been broken open and the paper handkerchiefs are removed from the casing as needed. Since the paper handkerchiefs packs are generally carried during this time in pockets of outer clothing or in purses, they are subject to various mechanical stresses that can cause the handkerchiefs to be crumpled or fall out of the foil envelope, and there is furthermore a risk that the handkerchiefs will become soiled as soon as the foil envelope has been opened by breaking a dispenser opening.

It is also important that the handkerchiefs be able to be dispensed in a simple way because it is often necessary that a handkerchief be quickly available for use.

Paper handkerchiefs packs are known in which the desire for easy dispensing of the handkerchiefs is met by providing a large dispenser opening, for example, a line of weakness with which the foil envelope in the area of its short, narrow side can be separated or opened by creating a flap. However, such a dispenser opening design has the disadvantage that in the course of usage of such packs the individual handkerchiefs can easily fall out of the foil envelope and are subject to relatively high risk of soiling. There is also known another paper handkerchiefs pack which has a line of weakness running in the middle area of the broadside surface of the foil envelope to form a dispenser opening, but the desire for easy dispensing of the handkerchiefs from the foil envelope is met only unsatisfactorily by this known pack because the fold of the handkerchiefs considered for this known pack often makes it difficult to take out them through the dispenser opening. For example, one fold was considered in which a narrow edge strip lying on the handkerchiefs at a longitudinal edge of the folded handkerchiefs is to be grasped through the dispenser opening to remove the handkerchief from the foil pack through this opening. However, it is often difficult to grasp the edge strips because they lie relatively tightly on the handkerchiefs and are held over a certain length in the foil envelope outside the area of the dispenser opening.

Prior art in the field of dispensers and folded tissues is exemplified by:

Watkins U.S. Pat. No. 3,272,385
Doyle U.S. Pat. No. 3,173,537
German Patent Application No. 2 512 140
German Patent Application No. 1 953 831

Watkins teaches a tissue dispenser box having a central hole, and a valve flap which can be moved downwardly into the box as the box is emptied of tissues. Doyle teaches a dispenser for photo-sensitive paper, including a cardboard box having an inner light-proof envelope. DE-OS No. 1 953 831 teaches a hermetically sealed plastic package with a cardboard insert in the top of the package for dispensing tissues therethrough. DE-OS No. 2 512 140 teaches Z-folding of tissues, which are then laid double and fourfolded.

The present invention avoids the necessity for multimaterial packages such as Doyle's, as well as the problems associated with large carboard dispenser boxes as taught by Watkins.

OBJECT OF THE INVENTION

It is the principal object of the present invention to provide a paper handkerchiefs pack which ensures good protection for handkerchiefs still remaining in the foil envelope after opening and which also permits simple and problem-free dispensing of the handkerchiefs so that they will be available for use quickly when needed.

SUMMARY OF THE INVENTION

The invented paper handkerchiefs pack is characterized by a combination of the following features:

a. The handkerchiefs have a fold whereby a corner at the outside of the folded handerchief lies free with the two edges extending from the corner, one of these edges running substantially in the middle of the longitudinal extend of the surface of the folded handkerchief from one longitudinal edge thereof to the other longitudinal edge thereof, while the other of these two edges runs along a longitudinal edge of the folded handkerchief, this fold being formed by a Z-shaped preliminary fold, the fold lines of which are parallel to each other and edge-parallel (square), and there is successive folding twice around fold lines running perpendicular to the aforementioned fold line.

b. The line of weakness runs over the middle of the broad upper surface of the foil envelope and preferably follows the edge of a geometrical surface figure on the surface extending over the middle of the broadside surface of the foil envelope.

The objective of the invention is achieved quite well with the invented structure. The paper handkerchiefs pack of the invention results in good protection of handkerchiefs, and permits easy dispensing thereof, and the simplicity of this concept permits realization at low cost with the further advantage that each handkerchief opens up automatically on dispensing. The line of weakness can run along a straight line or follow a bent curve. Dispensing is facilitated by the preferred embodiment in which the line of weakness or perforation line follows the edge of a geometrical surface figure on the upper surface of the foil envelope, and generally centered therein.

It is advantageous to have the line of weakness run along an oval or curve circumscribing the middle of the broad top surface of the foil envelope. Alternatively, other geometrical figures on the surface such as a triangles, rectangle, polygon, or star can also be utilized for forming the dispenser opening. It is also beneficial when the edge of a line of weakness following the geometrical surface figure leaves a small portion of the periphery of this geometrical surface figure unweakened, so that, when the line of weakness is pierced, a flap will be created that is attached to the envelope and lies in the middle of the dispenser opening.

This measure can also improve protection of the broken pack against soiling of the remaining paper handkerchiefs in the pack. It is also advantageous to maximize ease of opening of the flap for dispensing when the portion of the periphery of the geometrical surface figure left unweakened or unperforated lies in a zone of this geometrical surface figure that is adjacent to one of the shorter side edges of the broad top surface.

For easiest manipulation on dispensing and in the interests of good stability of the foil envelope, it is further advantageous to have the line of weakness define an oval the longitudinal extent of which runs in the direction of the longitudinal edge of the broad top surface. An advantageous development is provided when the oval has a greater width and a greater radius of curvature at one end than at the other, so that it will assume a profile similar to that of an egg.

A further embodiment showing particularly good properties with respect to the first opening procedure of the foil envelope and also a simple covering of the dispenser opening by at least one flap attached to the edge of said opening and therewith a good protection of the handkerchiefs being in the opened foil envelope against soiling is characterized in that the line of weakness runs along three geometrical line sections, two of said line sections lying spaced side by side and the third line section connecting said two first mentioned line sections and extending approximately perpendicularly thereto, so that these line sections form together approximately the shape of a "I", "H" or "C". A dispenser opening may be formed by the first opening procedure of the foil envelope by simple pressing down the line of weakness, said opening allows a good access for grasping the transverse edge of the free corner of the topmost handkerchief and being provided with one or two flaps attached to the edge of the dispenser opening, which flaps lie down automatically or by simple stroking across it onto the dispenser opening after withdrawal of a handkerchief, so that the dispenser opening is protected well against soiling.

For the first opening of the foil envelope and for covering the dispenser opening it is favourable, when the line sections each run along a straight line. Furthermore it is advantageous when the third line section lies approximately parallel to the longitudinal sides of the foil envelope above the edge of the topmost handkerchief of the pack which edge crosses the middle of the broad top surface of the foil envelope.

As mentioned, the paper handkerchiefs, which are withdrawn from the dispenser opening in the middle of the broad top surface of the inventive paper handkerchiefs pack by grasping a handkerchiefs edge running from one longitudinal edge to the other, open up automatically and are thus available for use in the opened-up form usually desired for use. Sometimes, however, it is desired that the handkerchiefs still be folded on removal from the foil envelope. For this purpose one embodiment of the paper handkerchiefs pack of the invention is characterized in that, besides the line of weakness running over the middle of the broad upper surface, the foil envelope has another line of weakness that on breaking open forms a dispenser opening that frees the front end of the stack of handkerchiefs.

BRIEF DESCRIPTION OF THE DRAWINGS

The invention is explained in more detailed examples that are represented schematically in the drawings, in which.

DETAILED DESCRIPTION

Figure 1:
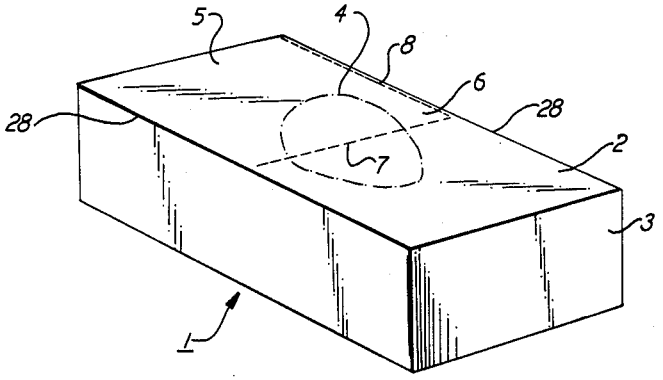
FIG. 1 is an isometric view of one embodiment of the paper handkerchiefs pack according to the invention.

The paper handkerchiefs pack 1 shown in FIG. 1 has a foil envelope 2, which is an all-around enclosure of a stack of folded handkerchiefs 3. These handkerchiefs are indicated in FIG. 1 by dotdash lines. To form a dispenser opening, the foil envelope has a line of weakness 4 arranged on the broad upper surface 5 of the foil envelope 2. This broad top surface follows the extent of the surface of the folded handkerchiefs 3. These handkerchiefs 3 have a first fold whereby a corner 6 at the outside of the folded handkerchief lies free with the two edges 7, 8 extending from it. The edge 7 runs substantially in the middle of the longitudinal extent of the surface of the folded handkerchiefs from one longitudinal edge to the other thereof, and the edge 8 runs along a longitudinal edge of the folded handkerchief.

Figure 2:
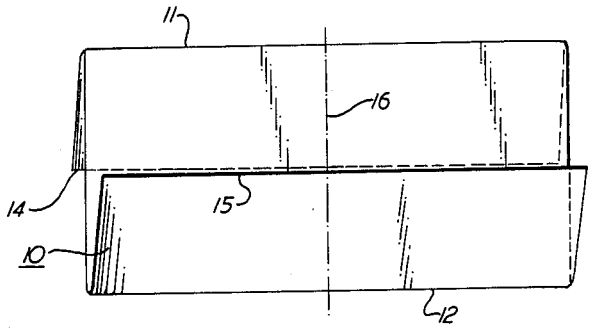
FIG. 2 shows the first stage of the folding of the paper handkerchief as required to form the pack according to the invention.
Figure 3:
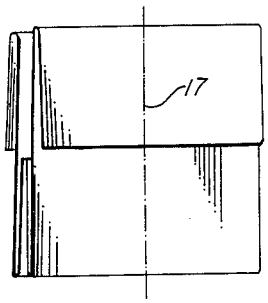
FIG. 3 shows the second stage of the folding of the paper handkerchief as required to form the pack according to the invention.
Figure 4:
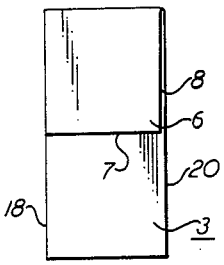
FIG. 4 shows the third stage of the folding of the paper handkerchief as required to form the pack according to the invention.

As FIGS. 2 to 4 show in detail, this special fold of the aforementioned paper handkerchiefs pack is produced from a Z-shaped preliminary fold 10, which is shown in FIG. 2. The fold lines 11, 12 of this preliminary fold run parallel to one another and parallel to the edges 14, 15 of the handkerchief. This preliminary fold is thereafter folded twice more. The first of these folds around a fold line 16 running perpendicular to the fold lines 11, 12 results in the structure shown in FIG. 3, which is folded again around a fold line 17, which line also runs perpendicular to the fold lines 11, 12. This gives the final structure shown in FIG. 4. As already mentioned, a corner 6 of the handkerchief lies free with the two edges 7, 8 extending from it on the outside of the folded tissue 3 with the edge 7 running substantially in the middle of the longitudinal extent of the surface of the handerchief 3 from one longitudinal edge 18 thereof to the other longitudinal edge 20 thereof and the other edge 8 of the corner 6 runs along the longitudinal edge 20.

Figure 5:
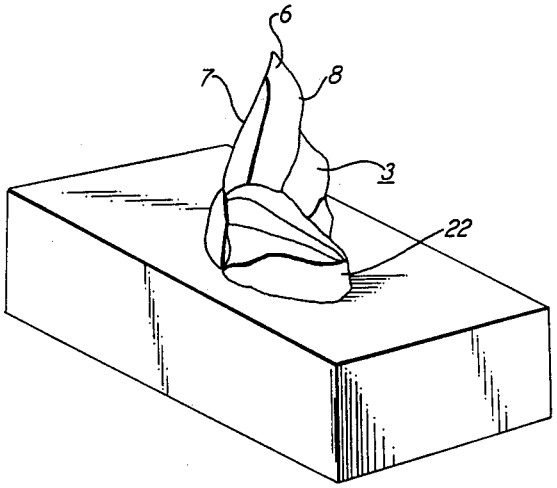
FIG. 5 shows the dispending of a paper handkerchief from a pack according to the invention.

The line of weakness 4 is located approximately in the middle of the broad upper surface 5 of the foil envelope 2, following the perimeter of a geometrical surface figure (shown as an oval in the case in FIG. 1) extending over the middle of the broad upper surface 5 of the foil envelope 2. This geometrical surface figure could also be a circle, a triangle, a rectangle, a polygon or a star or the like. Simple pressure on the line of weakness 4 can create a dispenser opening 22 which permits easy grasping of the edge 7 of the topmost handkerchief of the stack so that, as FIG. 5 shows, the edge 7 can be drawn in a simple way out of the dispenser opening 22, whereby the handkerchief opens up automatically on withdrawal, and is thus immediately ready for use.

As shown in FIG. 1, the line of weakness 4 can extend over the full periphery of a geometrical surface figure, and a piece of foil corresponding to the geometrical surface figure can be separated in this case by pressing in the line of weakness 4 and the handkerchiefs lie open under the dispenser opening so formed. As provided in the embodiments in FIGS. 6 and 7, however, a small portion 24 of the periphery of the geometrical surface figure selected is left unweakened, so that, when the line of weakness 4 is pierced, a flap 25 is formed, which remains attached to the foil 2, and covers the dispenser opening created when the line of weakness is pierced. It is advantageous here for manipulating the pack on dispensing the handkerchiefs that the portion 24 of the periphery of the geometrical surface figure left attached to the foil pack lies in a zone of this geometrical surface figure which is adjacent to one of the shorter side-edges 26 of the broad upper surface 5. If the line of weakness 4 follows a triangle, a rectangle or a polygon, the zone 24 can correspond to one side of the geometric surface figure. If the line of weakness follows a bent curve, zone 24 will lie between the end points thereof.

Figure 7:
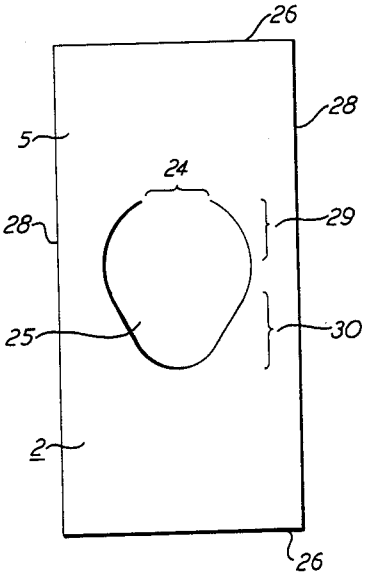
FIG. 7 is a plan view of the top surface of an alternative embodiment of the pack of the invention showing an ovate perforation in closed condition.
Figure 8:
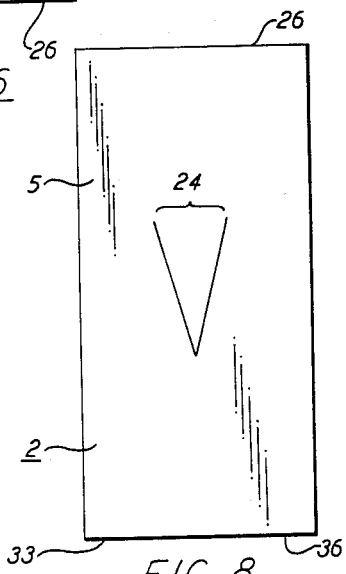
FIG. 8 is a plan view of the top surface of another alternative embodiment of the pack of the invention showing a triangular perforation.
Figure 9:
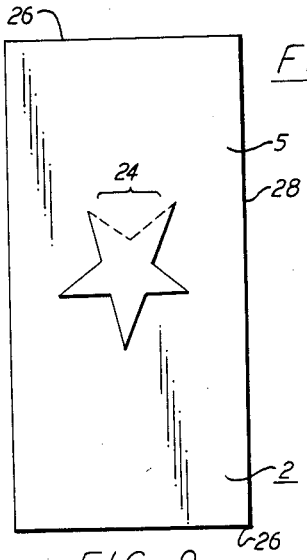
FIG. 9 is a plan view of the top surface of still another alternative embodiment of the pack of the invention, showing a star-shaped perforation.

If the line of weakness 4 follows an oval, it will be advantageous if, as also in the embodiments according to FIGS. 1 and 7, the longitudinal extent of the oval runs in the direction of the longitudinal edges 28 of the broadside surface 5. As mentioned above, it is also advantageous here if the oval has a greater width and a greater radius of curvature on one side 29 than on the other side 30, thus giving a profile similar to that of an egg, as can be seen in FIG. 7.

Figure 6:
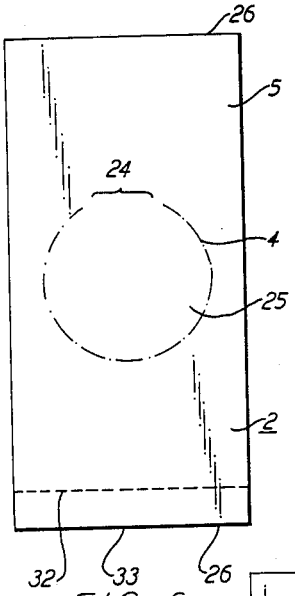
FIG. 6 is a plan view of the top surface of an embodiment of the pack of the invention, showing a circular perforation in closed condition and a second perforation for end opening of the pack.

In the embodiment shown in FIG. 6, the foil envelope 2 has, besides the line of weakness 4 running over the middle of the broad upper surface 5 and following the edge of a circle, another weakening line 32 running close to a short narrow side 33 of the foil envelope and forming a dispenser opening at the front end of the paper handkerchiefs stack when pierced. The handkerchiefs can be removed still folded from this dispenser opening and removal of the handkerchiefs from this dispenser opening can also be easily carried out with one hand.

Figure 10:
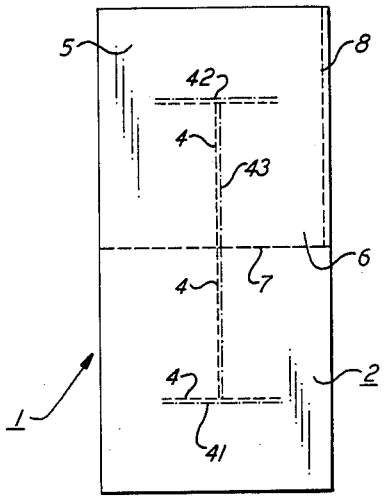
FIGS. 10, 12 and 13 are plan views of embodiments of packs of the invention in which the line of weakness of the foil envelope runs along line sections forming approximately the shape of a "I", "H" or "C".
Figure 11:
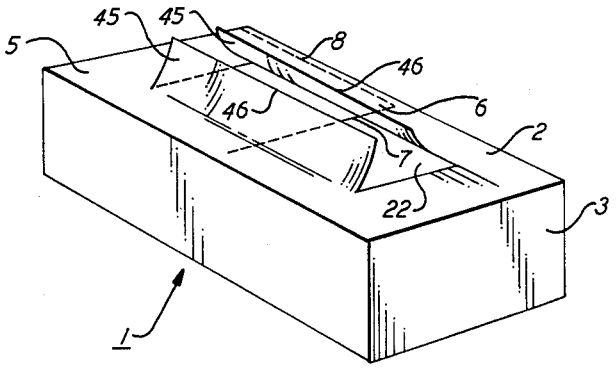
FIG. 11 shows the pack of FIG. 10 in opened condition.

In the pack shown in FIGS. 10 and 11 the line of weakness 4 runs along three geometrical line sections 41, 42, 43, the line sections 41, 42 being provided spaced side by side and the third line section 43 connecting the two line sections 41, 42. The third line section 43 lies approximately perpendicularly to the line sections 41, 42 and the three mentioned line sections form together approximately the shape of a "I". By simple piercing the line of weakness 4 the foil envelope 2 can be opened creating thereby a dispenser opening 22 (see FIG. 11), which opening allows to grasp easily the edge 7 of the topmost handkerchief of the stack. The respective handkerchief can be withdrawn by pulling out the edge 7 of the handkerchief from the dispenser opening of the pack. The handkerchief opens automatically and is available simultaneously for use.

Flaps 45 depend on the opposite edges of the dispenser opening 22, which flaps together cover the dispenser opening created by piercing the line of weakness 4. By the elasticity of the foil material normally these flaps 45 lie down again upon the dispenser opening after removal of a handkerchief from the pack and cover said opening, so that the paper handkerchiefs within the foil envelope are protected against soiling. If the flaps 45 do not come by their own elasticity in a position covering the dispenser opening 22 after removal of a handkerchief a simple wiping across the flaps will be sufficient so as to bring them into the position covering the dispenser opening 22. The run of the joining edges 46 of the flaps 45 and the line section 43 respectively, along which the foil envelope has been divided with creating the edges 46, in longitudinal direction of the pack 1, which is provided at this embodiment, allows to open and close the flaps 45 by a very simple manipulation for further removing operations of handkerchiefs. The rectilinear run of the line sections 41, 42, 43 and of the line of weakness 4 respectively also facilitates the first opening procedure of the foil envelope by piercing it along the lines of weakness.

Figure 12:
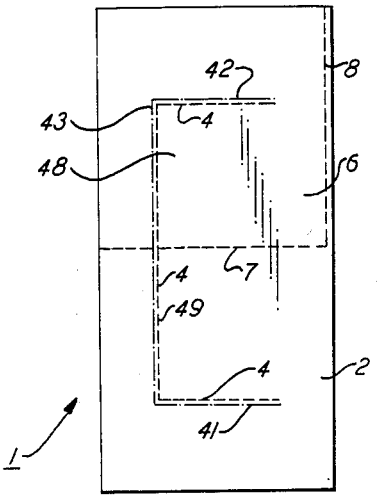

In the variant of embodiment shown in FIG. 12 a run of the line of weakness 4 similar to that of embodiment of FIG. 10 is provided, however, the third line section 43 meeting the two line sections 41, 42 which lie spaced side by side at opposite ends of the line sections 41, 42, so that the three line sections 41, 42, 43 form together approximately the shape of a "C". In this case a dispenser opening is obtainted by opening the pack by piercing the line of weakness. Said opening is covered by a single flap 48. This embodiment allows to close the dispenser opening by a more simple manipulation than in case of the embodiment according to FIG. 10 when the dispenser opening is closed after withdrawal of the paper handkerchief from the pack, if the elasticity of the foil material for putting back the flap 48 will not be sufficient and this flap is to be laid over the dispenser opening by wiping across. Also in this embodiment the third line section 43 to which the line of weakness 4 follows and therewith also the edge 49 of the flap 48 runs in longitudinal direction of the pack.

Figure 13:
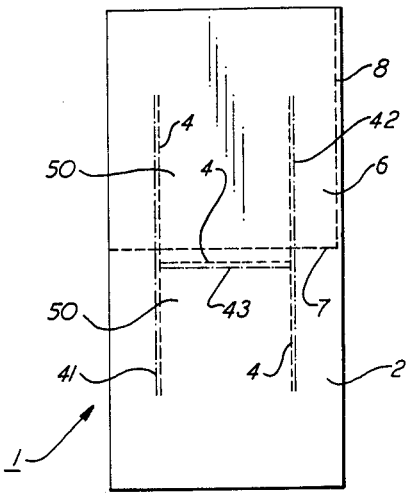

In the variant shown in FIG. 13 the line of weakness 4 runs along three line sections 41, 42, 43 forming together approximately the shape of a "H". In this case the two spaced line sections 41, 42, which lie side by side, run in logitudinal direction of the pack and the third line section 43 connecting the two line sections 41, 42 runs transversally thereto. By piercing the line of weakness 4 a dispenser opening can be formed which similar to the embodiment of FIG. 10 can be covered by two flaps 50 depending from opposite edges of the dispenser opening.

SUMMARY OF THE ACHIEVEMENTS OF THE OBJECT OF THE INVENTION

From the foregoing, it is readily apparent that I have provided a paper handkerchiefs pack which ensures good protection for handerchiefs still remaining in the foil envelope after opening and which also permits simple and problem-free dispensing of the handkerchiefs so that they will be available for use quickly when needed.

What is claimed is:

1. A paper handkerchief pack comprising:

a stack of folded handkerchiefs;

a foil envelope enclosing said stack of folded handkerchiefs on all sides and having broad top and bottom surfaces, said foil envelope having a line of weakness for forming a dispenser opening upon tearing, said line appearing only on the broad top surface of said foil envelope;

each of said handkerchiefs (3) of said stack having a fold whereby a corner (6) at the outside of folded handkerchief (3) lies free with two edges (7, 8) extending from it, one edge (7) of these two edges (7, 8) lying approximately in the middle of the longitudinal extent of the surface of the folded handkerchief from one longitudinal edge thereof to the other longitudinal edge thereof and the other edge (8) of these two edges (7, 8) running along a longitudinal edge of the folded handkerchief, the fold being a Z-shaped preliminary fold (10), the fold lines (11, 12) of which run parallel to each other and parallel to an edge (15) of the handkerchief;

said preliminary fold (10) being folded around a fold line (16) extending through the midst of the preliminary fold and perpendicularly to said fold lines (11, 12) of the preliminary fold, which creates two halves of the preliminary fold one laid upon the other, said two halves of the preliminary fold being folded together around a pair of fold lines (17) both extending through the midst of said two halves perpendicularly to said fold lines (11,12) of said preliminary fold; and said line of weakness (4) defining a geometrical surface figure extending over the middle of said broad upper surface (5) of the foil envelope, said geometrical figure being generally centered in the middle of the broad upper surface (5) of the foil envelope (2).

2. The pack of claim 1, in which the line of weakness (4) defines an oval circumscribing the middle of the broad upper surface (5) of the foil envelope.

3. The pack of claim 1, in which the line of weakness (4) defines a circle circumscribing the middle of the broad upper surface (5) of the foil envelope.

4. The pack of claim 1, in which the line of weakness (4) defining the edge of a geometrical figure leaves a small portion (24) of the periphery of said geometrical figure unweakened, thus creating a flap (25) attached to said envelope (2) and lying in the dispenser opening when the line of weakness is pierced.

5. The pack of claim 4, in which the line of weakness (4) defines a rectangle generally centered in the middle of the broad upper surface (5) of the foil envelope.

6. The pack of claim 4, in which the line of weakness (4) defines a triangle generally centered in the middle of the broad upper surface (5) of the foil envelope.

7. The pack of claim 4, in which the line of weakness (4) defines a polygon generally centered in the middle of the broad upper surface (5) of the foil envelope.

8. The pack of claim 4, in which the line of weakness (4) defines a star generally centered in the middle of the broad upper surface (5) of the foil envelope.

9. The pack of claim 4, in which the portion of the periphery of the geometrical figure left unweakened lies in a zone of said geometrical figure adjacent to one of the short side edges (26) of the broad upper surface (5).

10. The pack of claim 1, in which the line of weakness (4) defines an oval, the longitudinal extent of which lies in the direction of the longitudinal edges of the broad upper surface (5).

11. The pack of claim 10, in which the oval has a greater width and a greater radius of curvature at one end (29) than at the other end (30), and thus has a profile similar to that of an egg.

12. The pack of claim 1, in which the line of weakness (4) runs along three geometrical line sections (41, 42, 43), two of said line sections (41, 42) lying spaced side by side and the third line section (43) connecting said two first mentioned line sections and extending approximately perpendicularly thereto, so that all line sections together form approximately the shape of an "I".

13. The pack of claim 1, in which the line of weakness (4) runs along three geometrical line sections (41, 42, 43), two of said line sections (41, 42) lying spaced side by side and the third line section (43) connecting said two first mentioned line sections and extending approximately perpendicularly thereto, so that all line sections together form approximately the shape of an "H".

14. The pack of claim 1, in which the line of weakness (4) runs along three geometrical line sections (41, 42, 43), two of said line sections (41, 42) lying spaced side by side and the third line section (43) connecting said two first mentioned line sections and extending approximately perpendicularly thereto, so that all line sections together form approximately the shape of a "C".

15. The pack of claim 12, in which said line sections (41, 42, 43) each run rectilinearly.

16. The pack of claim 12, in which the third line section (43) extends approximately parallel to the longitudinal sides of the foil envelope (2) above the edge of the topmost handkerchiefs (3) of the pack which edge crosses the middle of the broad top surface (5) of the foil envelope.

17. The pack of claim 1, in which the foil envelope (2) has a second line of weakness (32) located close to and substantially parallel to the short narrow side (33) of the foil envelope (2), whereby, on breaking open said second line of weakness, a dispenser opening is formed at the front side of the stack of handkerchiefs.

* * * * *